US011091967B2

(12) United States Patent
Gohari et al.

(10) Patent No.: US 11,091,967 B2
(45) Date of Patent: Aug. 17, 2021

(54) STEAM AND INFLOW CONTROL FOR SAGD WELLS

(71) Applicants: Kousha Gohari, Calgary (CA); Oscar Becerra Moreno, Calgary (CA); Alexander Kendall, Houston, TX (US)

(72) Inventors: Kousha Gohari, Calgary (CA); Oscar Becerra Moreno, Calgary (CA); Alexander Kendall, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 26 days.

(21) Appl. No.: 16/421,157

(22) Filed: May 23, 2019

(65) Prior Publication Data

US 2020/0370382 A1 Nov. 26, 2020

(51) Int. Cl.

*E21B 21/08* (2006.01)
*E21B 17/18* (2006.01)
*E21B 21/12* (2006.01)

(52) U.S. Cl.

CPC ..... *E21B 21/08* (2013.01); *E21B 17/18* (2013.01); *E21B 21/12* (2013.01)

(58) Field of Classification Search

CPC ..... E21B 21/08; E21B 17/18; E21B 21/12; E21B 7/201; E21B 17/22; E21B 10/61; E21B 10/18

See application file for complete search history.

(56) References Cited

U.S. PATENT DOCUMENTS

| | | | | |
|---|---|---|---|---|
| 5,212,891 | A * | 5/1993 | Schuermann | E02F 3/9206 241/1 |
| 5,803,179 | A | 9/1998 | Echols et al. | |
| 6,112,815 | A | 9/2000 | Boe et al. | |
| 6,302,194 | B1 | 10/2001 | Kastner et al. | |
| 7,942,206 | B2 | 5/2011 | Huang et al. | |
| 8,162,239 | B2 * | 4/2012 | Hursen | B05B 1/3006 239/571 |
| 8,925,633 | B2 | 1/2015 | Nguyen | |
| 9,638,000 | B2 | 5/2017 | Dyck | |
| 10,208,575 | B2 | 2/2019 | Gohari et al. | |
| 2006/0196658 | A1 | 9/2006 | Belcher | |
| 2009/0205834 | A1 | 8/2009 | Garcia et al. | |
| 2015/0204145 | A1 | 7/2015 | Richards et al. | |
| 2018/0045027 | A1 * | 2/2018 | Haley | E21B 43/121 |

* cited by examiner

*Primary Examiner* — Yong-Suk (Philip) Ro
(74) *Attorney, Agent, or Firm* — Cantor Colburn LLP

(57) ABSTRACT

A downhole flow control configuration including a housing, a converging-diverging flow path in the housing. The flow path includes a first portion including an inlet, a converging section, and a throat section. The first portion preferentially passes a portion of a fluid having a greater subcool. The converging-diverging flow path further includes a second portion comprising a diverging section that recovers fluid pressure lost in the converging section and the throat section, and an outlet and an elongated helical flow path connected to the outlet of the converging-diverging flow path, the helical flow path producing a pressure drop in a fluid flowing therein during use.

8 Claims, 3 Drawing Sheets

STEAM AND INFLOW CONTROL FOR SAGD WELLS

BACKGROUND

In the resource recovery industry, flow control devices must contend with fluids of differing densities and subcool status. This is particularly the case in Steam Assisted Gravity Drainage (SAGD) systems. Steam breakthrough in such systems is detrimental to the recovery of target fluids. Hence excluding steam while still allowing subcooled fluids through a flow control device is desirable. The art has attempted to create flow control devices that reach this ideal and some have made progress but none have met the ideal. The art is still in search of better results and hence is always receptive to innovations.

SUMMARY

An embodiment of a downhole flow control configuration including a housing, a converging-diverging flow path in the housing, the flow path including a first portion including an inlet, a converging section, and a throat section, the first portion preferentially passing a portion of a fluid having a greater subcool, and the converging-diverging flow path further including a second portion comprising a diverging section that recovers fluid pressure lost in the converging section and the throat section, and an outlet and an elongated helical flow path connected to the outlet of the converging-diverging flow path, the helical flow path producing a pressure drop in a fluid flowing therein during use.

An embodiment of a method for controlling fluid flow in a downhole tool including flowing fluid into a subcool/steam quality part of the tool and preferentially passing fluid that is at a greater subcool; flowing fluid passed through the first portion of the tool into a length based pressure drop part of the tool; and dropping pressure of the fluid in the length based pressure drop part of the tool.

BRIEF DESCRIPTION OF THE DRAWINGS

The following descriptions should not be considered limiting in any way.

DETAILED DESCRIPTION

A detailed description of one or more embodiments of the disclosed apparatus and method are presented herein by way of exemplification and not limitation with reference to the Figures.

Figure 1:
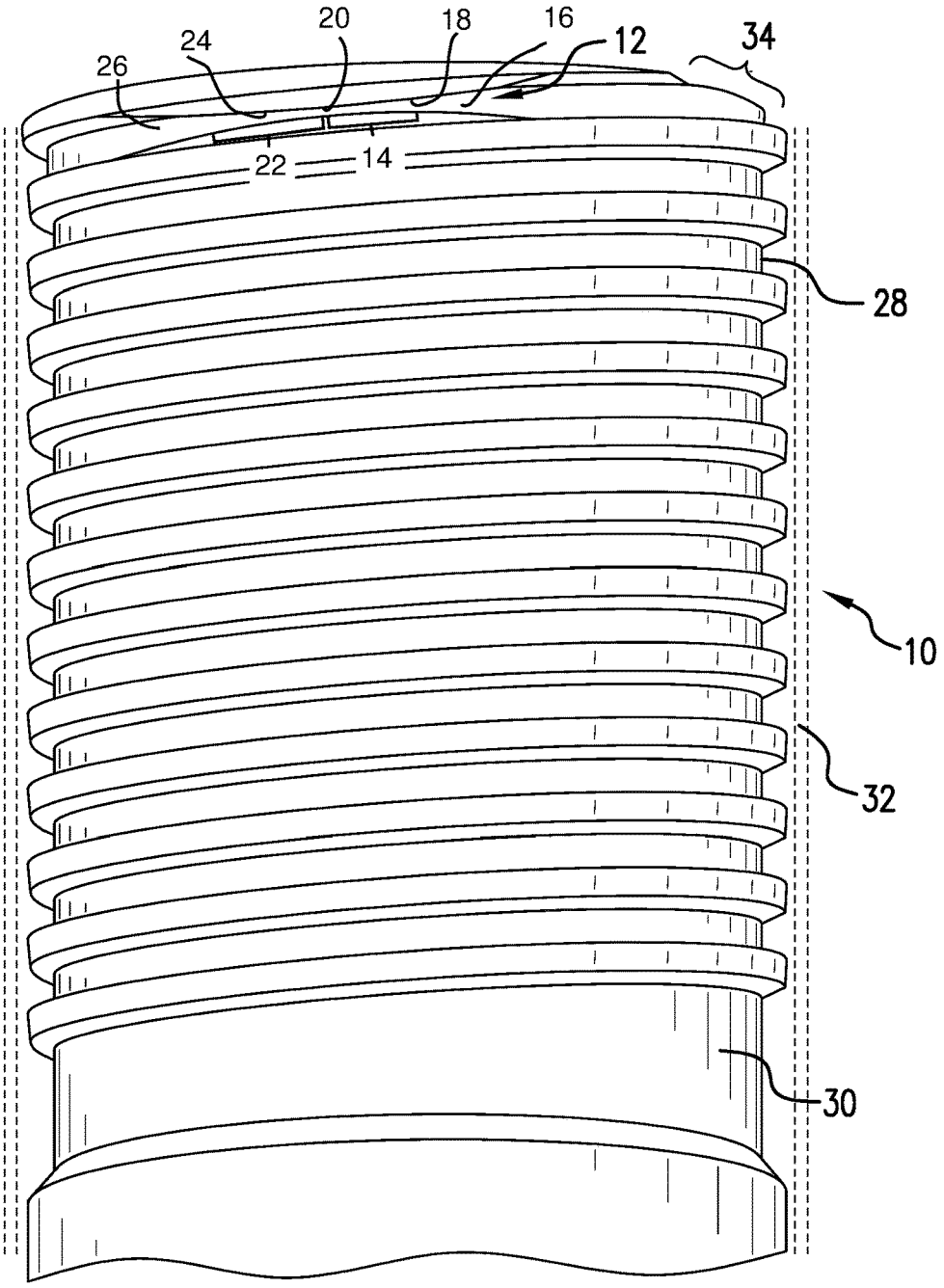
FIG. 1 is a representation of a downhole flow control configuration as disclosed herein.

Referring to FIG. 1, a downhole flow control configuration 10 is illustrated. The configuration includes a converging-diverging flow path 12. Flow path 12 includes a first portion 14 comprising an inlet 16, a converging section 18, and a throat section 20. The flow path further includes a second portion 22 that comprises a diverging section 24 and an outlet 26. The first portion 14 preferentially passes fluid having a greater subcool. Stated alternatively, fluid entering the first portion 14 may be at different degrees of subcool and may be close to evolving steam. The smaller the subcool of the fluid the closer it is to evolving steam while the greater the subcool, the farther it is from evolving steam. Since steam breakthrough is undesirable, the first portion is helpful in that it tends to exclude or reduce the passage of fluids having a lower subcool characterization. In other words, the first portion 14 tends to exclude fluid that is close to evolving steam. For fluids that have a greater degree of subcool, the first portion presents almost no impediment and therefore encourages passage of greater subcool fluids therethrough. The second portion 22 on the other hand recovers fluid pressure lost by the fluid flowing through the first portion 14.

The outlet 26 is connected to an elongated helical flow path 28 that produces a pressure drop in a fluid flowing therein during use. The amount of pressure drop is adjustable by the length of the helical flow path 28. In an embodiment the helical flow path 28 is created on an outside diameter of a cylindrical structure 30 that may be solid or tubular. In such embodiment, an outer housing 32 provides the enclosure to make the flow path 28 complete. Outer housing 32 may be installed by heating and shrinking to a tight fit against the structure 30 and pathway 28. Alternatively the pathway 28 may be formed through an additive manufacturing process. Further details of a pressure drop device employing the helical pathway as described herein may be found in U.S. Pat. No. 10,208,575 the entirety of which is incorporated herein by reference.

The converging-diverging flow path 12 may as illustrated in FIG. 1 be a part of the same material of the helix and might be manufactured by subtractive machining or additive manufacture. In alternate embodiments, the converging-diverging flow path 12 may be produced by disposing a separate component or insert in the path 28 of the structure 30 (as in FIGS. 2-4). The converging-diverging flow path may be effected at or near an entry end 34 of the flow path 28. Inserts may be constructed of ceramic, metal, other erosion resistant materials and combinations including one or more of the foregoing.

Figure 2:
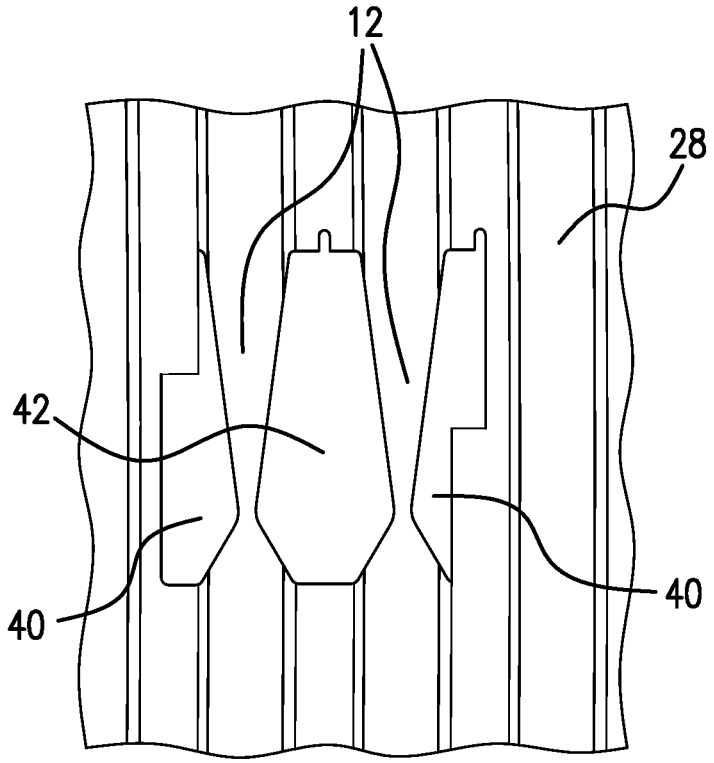
FIG. 2 is an alternate embodiment plan view of the flow path wherein inserts are employed.
Figure 3:
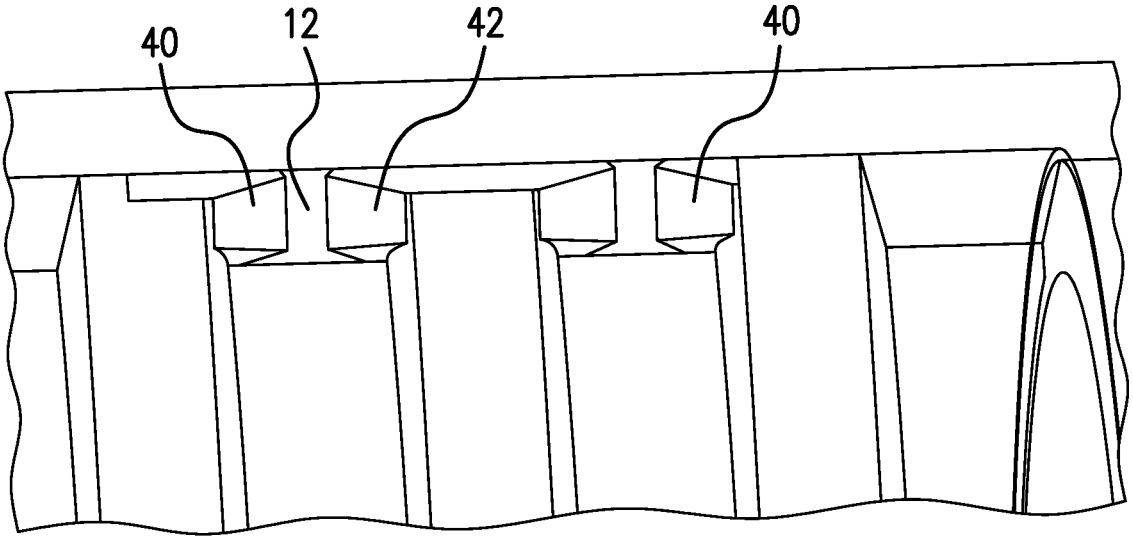
FIG. 3 is a side view of the same embodiment as FIG. 2.

Referring to FIGS. 2 and 3, flow path 12 is created within the flow path 28 by the addition of inserts 40 and 42. As illustrated two converging-diverging flow paths 12 are illustrated and the image illustrates two types of inserts. Insert 40 provides one side of a converging-diverging path. It can be used with another insert 40 to create one converging-diverging flow path 12 or can be used with an insert 42 that is configured to produce two adjacent converging-diverging flow paths 12 as shown. It is to be appreciated that one or more converging-diverging flow paths are contemplated for use in a configuration 10 depending upon desires of the operator.

In FIG. 3 it can be seen that the flow path 12 is bounded laterally by inserts 40 and 42, at the radially inward surface by structure 30 and at a radially outward surface by housing 32. The inserts allow for more rapid placement of a converging-diverging flow path 12 at any location within flow path 28. They further allow for easy refurbishment of the path 12 if needed due to for example, erosion over time.

Figure 4:
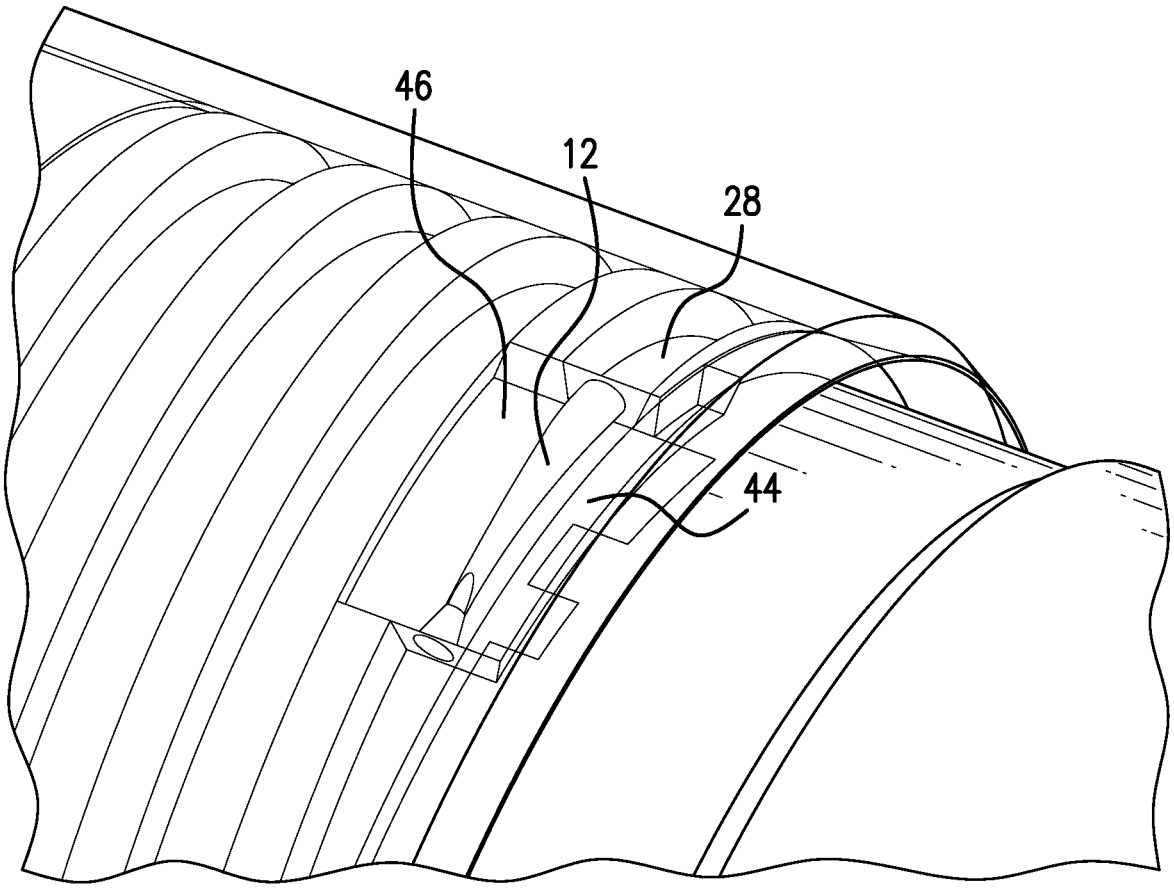
FIG. 4 is another alternate embodiment where a different insert is employed.

Referring to FIG. 4, another alternate embodiment is illustrated wherein an insert 44 contains the entirety of the converging-diverging flow path 12. This insert provides all surfaces of the flow path 12 and hence may benefit from reduced erosion and if replaced due to erosion, will result in the entire flow path 12 being renewed rather than just lateral surfaces thereof as in the embodiment of FIG. 2. Insert 44 may be deposited in a recess 46 that removed a portion of the helical flow path 28 or may be placed within the helical flow path 28 in different iterations. Where a portion of the path 28 is milled away or simply not printed if an AM process is used to produce the configuration, the insert 44 will be inherently located and will not move. Where the insert 44 is intended to sit within the flow path 28, provision such as interference fit, welding, bonding, etc. will be needed to ensure the insert 44 does not move within the flow path 28

By incorporating both a converging-diverging flow path that provides a choke responsive to the subcool/steam quality of fluid entering the inlet thereof with the helical flow path, which provides an easily configurable length-based pressure drop that responds to fluid density, a vastly superior flow control device is created that subjects flow having very sub cooled fluid to minimal restriction and yet protects the helical pressure drop portion of the combined device from steam thereby maximizing desired fluid recovery.

Set forth below are some embodiments of the foregoing disclosure:

Embodiment 1: A downhole flow control configuration including a housing, a converging-diverging flow path in the housing, the flow path including a first portion including an inlet, a converging section, and a throat section, the first portion preferentially passing a portion of a fluid having a greater subcool, and the converging-diverging flow path further including a second portion comprising a diverging section that recovers fluid pressure lost in the converging section and the throat section, and an outlet and an elongated helical flow path connected to the outlet of the converging-diverging flow path, the helical flow path producing a pressure drop in a fluid flowing therein during use.

Embodiment 2: The configuration as in any prior embodiment wherein the converging-diverging flow path is constructed as an insert for disposition in a housing having the elongated helical flow path.

Embodiment 3: The configuration as in any prior embodiment wherein the insert is two cooperating inserts producing sides of the converging-diverging flow path.

Embodiment 4: The configuration as in any prior embodiment wherein the insert contains the entire converging-diverging flow path.

Embodiment 5: The configuration as in any prior embodiment wherein the insert is disposed in a recess of the helical flow path.

Embodiment 6: The configuration as in any prior embodiment wherein the insert is formed from erosion resistant material.

Embodiment 7: The configuration as in any prior embodiment wherein the material comprises at least one of ceramic or metallic and combinations include one or more of the foregoing.

Embodiment 8: A method for controlling fluid flow in a downhole tool including flowing fluid into a subcook/steam quality part of the tool and preferentially passing fluid that is at a greater subcool; flowing fluid passed through the first portion of the tool into a length based pressure drop part of the tool; and dropping pressure of the fluid in the length based pressure drop part of the tool.

Embodiment 9: The method as in any prior embodiment wherein the passing further includes flowing fluid through a converging-diverging flow path.

Embodiment 10: The method as in any prior embodiment wherein the dropping pressure includes flowing the fluid through a helical flow path.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole flow control configuration comprising:
a housing;
a converging-diverging flow path in the housing, the flow path including:
a first portion comprising:
an inlet,
a converging section, and
a throat section,
the first portion preferentially passing a portion of a fluid having a greater subcool, and
the converging-diverging flow path further including:
a second portion comprising:
a diverging section that recovers fluid pressure lost in the converging section and the throat section, and
an outlet; and
an elongated helical flow path connected to the outlet of the converging-diverging flow path, the helical flow path producing a pressure drop in a fluid flowing therein during use.

2. The configuration as claimed in claim 1 wherein the converging-diverging flow path is constructed as an insert for disposition in a housing having the elongated helical flow path.

3. The configuration as claimed in claim 2 wherein the insert is two cooperating inserts producing sides of the converging-diverging flow path.

4. The configuration as claimed in claim 2 wherein the insert contains the entire converging-diverging flow path.

5. The configuration as claimed in claim 2 wherein the insert is disposed in a recess of the helical flow path.

6. The configuration as claimed in claim 2 wherein the insert is formed from erosion resistant material.

7. The configuration as claimed in claim 6 wherein the material comprises at least one of ceramic or metallic and combinations include one or more of the foregoing.

8. A method for controlling fluid flow in a downhole tool comprising:

flowing fluid into a part of the tool and preferentially passing fluid that is at a greater sub cool; wherein the passing further includes flowing fluid through a converging-diverging flow path; and flowing fluid passed through the first portion of the tool into a helical flow path pressure drop part of the tool; and dropping pressure of the fluid in the helical flow path pressure drop part of the tool.

* * * * *